United States Patent [19]

Llach et al.

[11] 4,027,358

[45] June 7, 1977

[54] VARIABLE SPEED DRIVE SYSTEM FOR CARDING MACHINE

[75] Inventors: Lorenzo Llach, Marietta; Arturo Picas, Athens, both of Ga.

[73] Assignee: Canton Textile Mills, Inc., Canton, Ga.

[22] Filed: Aug. 18, 1975

[21] Appl. No.: 605,635

Related U.S. Application Data

[63] Continuation-in-part of Ser. No. 545,195, Jan. 29, 1975, Pat. No. 3,982,301.

[52] U.S. Cl. ..... 19/106 R; 19/.25; 74/230.17 A

[51] Int. Cl.[2] ..... D01G 15/46

[58] Field of Search ..... 19/106 R, 98, .2, .23, 19/.25, 105, .21; 74/230.16, 230.17 A, 230.18, 244

[56] References Cited

UNITED STATES PATENTS

| | | | |
|---|---|---|---|
| 605,057 | 5/1898 | Hopkinson et al. | 19/106 R |
| 623,950 | 4/1899 | Eaton | 19/106 R |
| 2,141,003 | 12/1938 | King et al. | 19/106 R |
| 2,639,470 | 5/1953 | White | 19/.25 |
| 3,242,749 | 3/1966 | Schwalm | 74/230.17 A |
| 3,300,817 | 1/1967 | Binder et al. | 19/.21 |
| 3,807,248 | 4/1974 | Hooper | 74/230.17 A X |

*Primary Examiner*—Dorsey Newton
*Attorney, Agent, or Firm*—Jones, Thomas & Askew

[57] ABSTRACT

A variable speed drive system for a carding machine employs a variable pitch pulley assembly that rotates the feed cylinder and doffer cylinder at a constant slow speed as the sliver is made up to the coiler can, and after a predetermined time lapse the speed of the feed cylinder and doffer automatically and progressively increase at a fixed speed ratio from the slow speed condition to a constant high speed condition. If the sliver is not made up properly within the time lapse, the operation of the feed cylinder and doffer cylinder is automatically terminated.

5 Claims, 3 Drawing Figures

VARIABLE SPEED DRIVE SYSTEM FOR CARDING MACHINE

CROSS REFERENCE TO RELATED APPLICATION

This application is a continuation-in-part of applicaion Ser. No. 545,195, filed Jan. 29, 1975, now U.S. Pat. No. 3,982,301, "VARIABLE DRIVE MECHANISM FOR CARDING MACHINE".

BACKGROUND OF THE INVENTION

In the manufacture of yarn, the usual process comprises feeding raw cotton fiber into a carding machine through a feed system such as a feed roll and a licker-in to the main large cylinder for the purpose of refining and parallelizing the fibers. The parallel fibers are removed from the main cylinder in the form of a continuous web by a smaller doffing cylinder, and the web is taken from the doffer to a funnel or trumpet which gathers the web into a sliver. The sliver moves from the trumpet between calendar rolls and is directed through a coiler head and into a coiler can where the sliver is coiled for further storage, handling and ultimate removal for further processing into yarn.

In order to prevent the web and sliver from breaking or tearing during the start-up procedures of a carding machine, the carding machine is run at a relatively slow speed. Although the slow speed allow continuous production of the sliver, the production rate is slow. Some carding machines have included means for varying the doffer speed, and after the sliver is made up to the coiler can the drive system is manually shifted to increase the production rate. The two speed prior art systems have not been very satisfactory since only two fixed speeds of operation are provided and it is required to replace the gears of a machine to change the high production rate of the machine. Moreover, the typical high speed to low speed production rate in most operational carding machines is three to one and produces 23 pounds of cotton per hour at slow speed production and 69 pounds per hour at high speed production, and when a gear replacement is made to increase the high speed production, the low speed operation is also proportionately increased, making it more difficult for the card operator to make up the sliver to the coiler can. Also, the use of cumbersome driving belts and other elements associated with these systems occupy a substantial amount of floor space adjacent the machine and most driving systems cause the doffer to continue rotating after the system has been deactivated, which results in the production of waste. The shift from low to high speed production in the prior art carding machines is abrupt and causes imperfections in the resulting sliver.

SUMMARY OF THE INVENTION

Briefly described, the present invention comprises a variable speed drive system for a carding machine wherein a variable pitch pulley drive system drives the doffer cylinder and feed cylinder, and a control means allows the doffer cylinder and feed cylinder to operate at a constant slow speed for a predetermined period in which time the machine operator is expected to make up the sliver and feed the sliver to the coiler can. After the time lapse and if the sliver is properly made up to the coiler, the variable pitch pulley drive system automatically, progressively and smoothly increases the rotational speed of the doffer cylinder and feed cylinder from the constant slow speed to a constant high speed. If the sliver is not made up within the predetermined period to the coiler can, the operation of the doffer cylinder and feed cylinder is terminated. The high speed condition of the drive system is variable and can be adjusted while the doffer and feeder cylinders are operating, without requiring shut down and dismantling of the machine.

Thus, it is an object of the invention to provide a variable speed drive system for a carding machine which automatically functions to operate the doffer cylinder and feed cylinder at a constant slow speed for a predetermined period during which time the operator makes up a sliver to the coiler can, and subsequently, progressively and smoothly increases the speed of the doffer cylinder and feed cylinder to a constant high speed.

Another object of the present invetion is to provide an inexpensive and reliable variable speed drive system for a carding machine which progressively and smoothly changes the speed of operation of the feed cylinder and doffer cylinder from a constant slow speed to a constant high speed.

Another object of the present invention is to provide an improved speed control system for a carding machine which allows the sliver to be made up at slow speed and which automatically functions to increase the production of the machine after the sliver has been made up.

Other objects, features and advantages of the present invention will become apparent upon reading the following specification, when taken in conjunction with the accompanying drawing.

DETAILED DESCRIPTION

Figure 1:
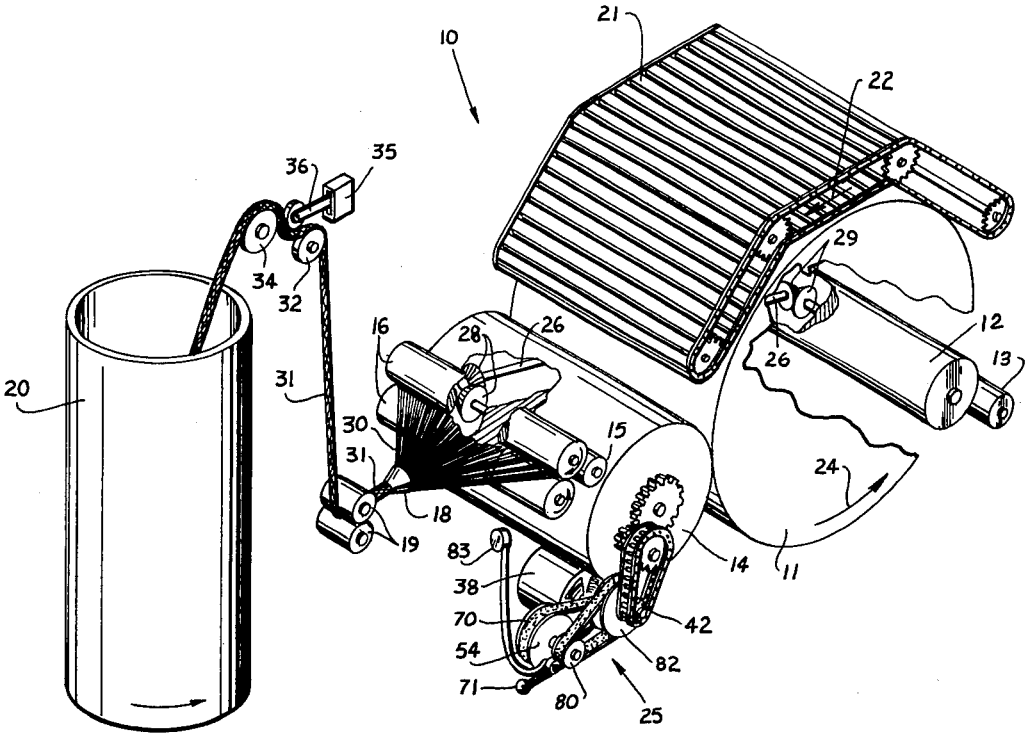
FIG. 1 is a schematic perspective view, with parts broken away, of a portion of a carding machine.

Referring now in more detail to the drawing, in which like numerals indicate like parts throughout the several views, FIG. 1 schematically illustrates a carding machine 10 which includes a main card cylinder 11, a licker-in 12, a feed cylinder 13, a doffer cylinder 14, takeoff roll 15, crush rolls 16, trumpet 18, calendar rolls 19, and coiler can 20. A plurality of slats 21 are positioned above main card cylinder 11 on a continuous conveyor system with the lower flight of slats moving slowly in the direction indicated by arrow 22 while the main card cylinder moves more rapidly in the direction indicated by arrow 24. A motor (not shown) functions to drive main card cylinder 11, slats 21 and various other components of the system in timed relationship, as is conventional in the art.

Variable speed drive system 25 is positioned adjacent and partially beneath doffer cylinder 14 and functions to rotate doffer cylinder 14. The drive system is normally enclosed in a housing, but the housing has been removed for purposes of illustration. A drive shaft 26 is connected at one of its ends to doffer cylinder 14 by beveled gears 28, and the other end of the drive shaft 26 is connected by beveled gears 29 to feed cylinder 13. A clutch (not shown) is included in drive shaft 26 which enables doffer cylinder 14 and feed cylinder 13 to be rotated independently of each other, when desired, but the usual arrangement is to have doffer cylinder 14 and feed cylinder 13 to rotate at a fixed speed ratio.

When the cotton is passed through the main card cylinder 11, the cotton is removed by the doffer cylinder 14 in the form of a web 30, and the web is subsequently removed from the doffer cylinder 14 by the takeoff roll 15 and passed between the crush roll 16. The trumpet 18 funnels the web 30 into a sliver 31, and the sliver passes between calendar rolls 19 and about guide rolls 32 and 34 to coiler can 20 (schematically shown without coiler head). A sliver detector switch 35 includes a feeler arm 36 that is biased toward engagement with sliver 31 and functions as a detecting means to detect the presence or absence of the sliver by the position of the feeler.

Figure 2:
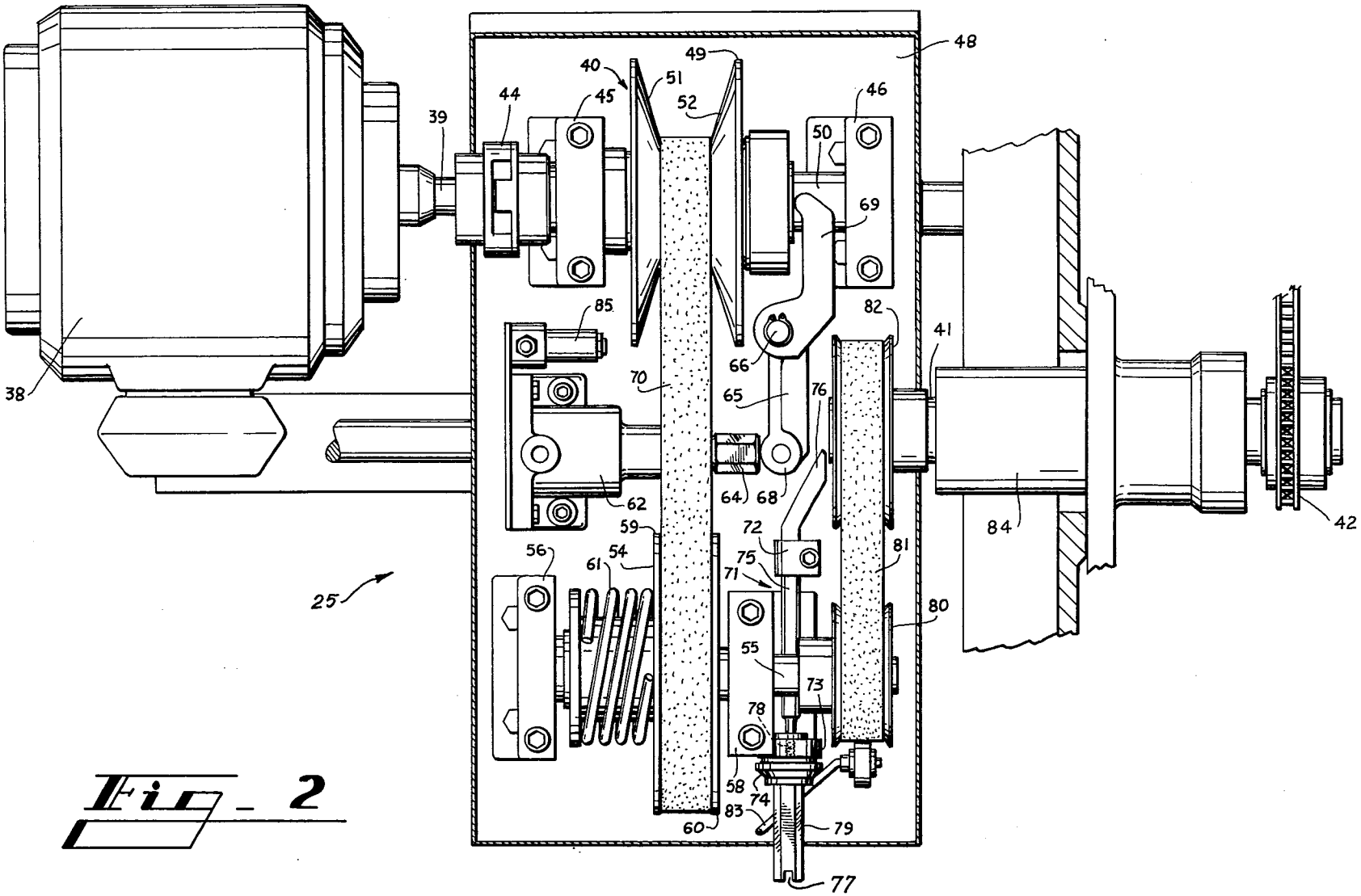
FIG. 2 is a plan view of the variable speed drive system for the doffer cylinder.

As is illustrated in FIG. 2, the variable speed drive system 25 for the carding machine 10 includes a motor 38 having a drive shaft 39, a variable pitch pulley drive assembly 40 and a driven shaft 55 which is connected to a gear reduction assembly 42 (FIG. 1), which functions to drive doffer cylinder 14 and feed roll 13. Variable pitch pulley drive assembly 40 includes a coupling 44 connected to motor drive shaft 39, bearing blocks 45 and 46 mounted on support plate 48 and variable pitch pulley 49. Pulley 49 is mounted on a shaft 50 which is connected to coupling 44 with the sheave half 51 rigidly connected to shaft 50 and the opposite sheave half 52 movable along the length of shaft 50. The variable pitch pulley 49 functions as a driving pulley.

The variable pitch pulley 54 is mounted on a driven shaft 55 supported by bearing blocks 56 and 58 from support plate 48 and includes driven sheave halves 59 and 60, with sheave half 60 rigidly connected to the driven shaft 55 and the sheave half 59 movable along the length of shaft 55 toward and away from sheave half 60. Coil compression spring 61 is mounted about driven shaft 55 between bearing block 56 and movable sheave half 59 to urge the sheave half 59 toward sheave half 60.

Fluid actuated ram 62 is mounted on support plate 48 and includes a distendable ramrod 64 which engages one end of fork lever 65. Fork lever 65 is pivotally mounted at a position intermediate its ends on a vertical axle 66 with one end 68 of the fork lever 65 positioned in the line of movement of the ramrod 64 of the fluid actuated ram 62 and with the opposite forked end 69 spanning the drive shaft 50 of the variable pitch driving pulley 49. When the ramrod 64 distends, the fork lever 65 pivots in a counterclockwise direction (FIG. 2) so that the forked end 69 of the lever urges the movable sheave half 52 toward the opposite sheave half 51 along the drive shaft 50 to close the pitch of the variable pitch driving pulley 49.

Drive shaft 50 and driven shaft 55 are parallel to each other and the variable pitch driving and driven pulleys 49 and 54 are in alignment with each other on their respective shafts 50 and 55, and V-belt 70 extends about the variable pitch pulleys as shown. The inner surfaces of the sheave halves of the variable pitch pulleys are cone-shaped, and when a movable sheave half is urged toward a fixed sheave half, the configuration of the V-belt in cooperation with the cone-shaped surfaces of the sheave halves causes the V-belt to tend to move to the outside perimeter of the pulley, where the linear speed of the V-belt with respect to a constant rotational speed of the pulley is increased. With this arrangement, when the fluid actuated ram 62 distends its ramrod to pivot fork lever 65 in a counterclockwise direction, the movable sheave half 52 of the variable pitch driving pulley will move toward the fixed sheave half 51 to close the pitch of the pulley, and the V-belt 70 will then be forced closer to the outer perimeter of the variable pitch driving pulley. In the meantime, the coil compression spring 61 will be forced to contract and to allow the movable sheave half 59 of the variable pitch driven pulley 54 to move away from the fixed sheave half 60 and allow the V-belt to move from the outer perimeter of the pulley toward the center of the pulley. This results in a change in speed ratio between the pulleys.

Limiting means 71 is mounted on support plate 48 and comprises shaft 75 extending from bearing block extension 73 through bracket 72 and terminates at an angle beyond bracket 72 to form an angled cam abutment 76. Shaft 75 includes a threaded stud 78 which is received in the threads of socket shaft 79, and socket shaft 79 extends through bearing block extension 73 and terminates in collar 74 and includes internal threads which engage the threads of the stud 78. Socket shaft 79 extends from collar 74 away from shaft 75 and terminates with a key slot 77 at its outer end which protrudes through the housing (not shown) of the variable speed drive. When socket shaft 79 is rotated by means of a screwdriver, etc. being inserted into its key slot 77, the cooperating threads of the socket shaft and stud function to move shaft 75 along its length to move the cam surface 76 further toward or away from the end 68 of the fork lever 65. The cam surface 68 acts as an abutment to the end 68 of the fork lever 65 and limits the arc that fork lever 65 can move in a counterclockwise direction. This effectively limits the stroke of ramrod 64 and the distance that movable sheave half 52 can move toward fixed sheave half 51 of the variable pitch driving pulley 49, and the speed ratio between variable pitch driving pulley 49 and variable pitch driven pulley 54. Thus, the limiting means 71 functions as a speed control and to variably limit the high speed of the variable speed drive system by limiting the reduction of the pitch of the variable pitch driving pulley.

Driven shaft 55 is connected to timing pulley 80, a timing belt 81 extends about the timing pulley 80 and about aligned timing pulley 82, and the timing pulley 82 is connected through bearing housing 84 to the first gear of the gear reduction assembly 42. A tachometer 83 is connected to a driven portion of the variable drive system to provide an indication of the rotational speed of the doffer cylinder, and its gauge is positioned at a convenient location outside the housing (not shown) of the drive system to permit the card operator to watch the gauge when adjusting limiting means 71.

Solenoid air valve 85 functions to control a flow of pressurized air to the fluid actuated ram 62. A supply of air under pressure (not shown) is connected to the solenoid valve 85, and when the valve is actuated, the air supply is connected to the fluid actuated ram 62. When the valve is deactuated, the ram 62 is vented to the atmosphere.

Figure 3:
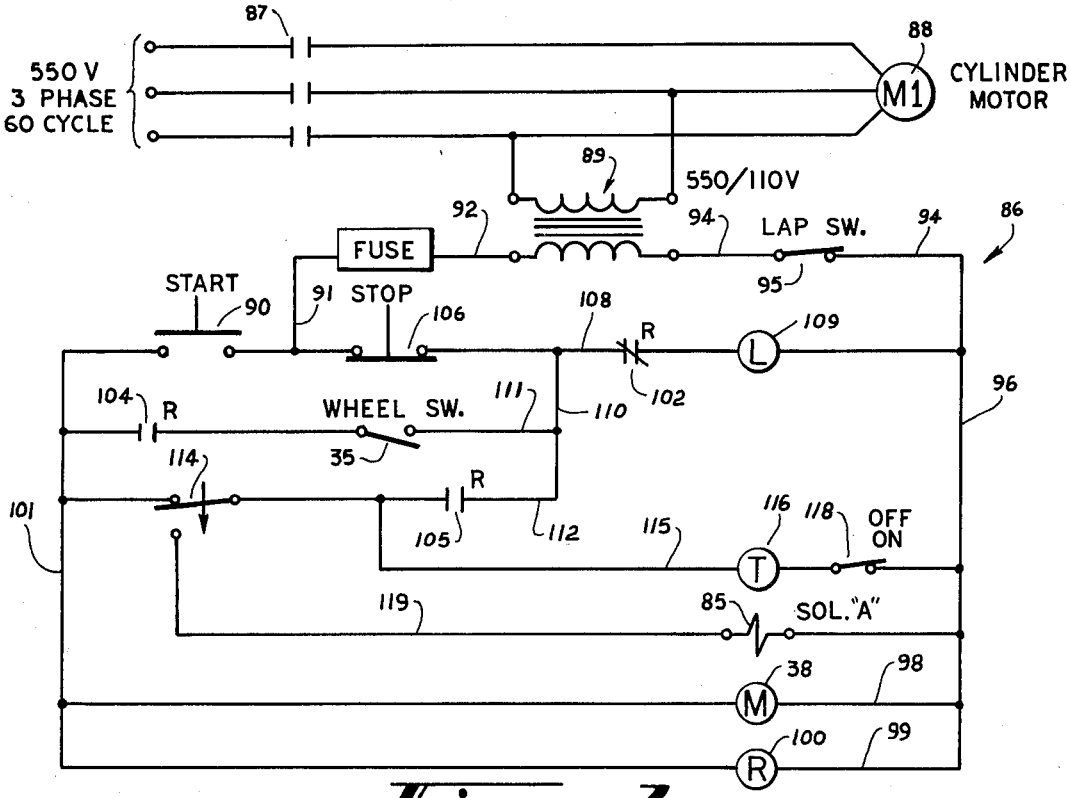
FIg. 3 is an electrical schematic of the electrical control system.

As is illustrated in FIG. 3, motor 88 operates the main card cylinder 11 and switch 87 controls the on-off condition of the motor. The electrical control system 86 is connected to the electrical supply of the motor 88 that rotates the main card cylinder 11 by means of transformer 89. When the main card cylinder is in operation with switch 87 closed, and when start switch 90 of the control system is closed, a circuit is made from start switch 90 through conductors 91 and 92 to the transformer 89, through conductor 94, lap switch 95, conductor 96, conductors 98 and 99 in parallel, electric motor 38 and relay 100, and conductor 101. When motor 38 is energized, it begins the rotation of variable pitch driving pulley 49, and when relay 100 is energized, it opens normally closed relay contacts 102 and closes normally open relay contacts 104 and 105. Relay contacts 102 are in a circuit made from transformer 89, conductor 92, conductor 91, stop switch 106, conductor 108, indicating lamp 109, conductor 96, lap switch 95 and conductor 94. Thus, if lap switch 95 is closed prior to the closing of start switch 90, lamp 109 will be illuminated, which indicates that a supply of cotton is present to be received by the feed cylinder; however, once the start switch 90 is closed and relay 100 is actuated so that its relay contact 102 is open, lamp 109 will no longer be illuminated.

Normally open relay contacts 104 comprises a portion of a holding circuit together with sliver detector switch 35, so that when relay 100 is energized and closes its contacts 104, a circuit will be made from transformer 89 through conductors 92 and 91 through stop switch 106, conductor 110, conductor 111, sliver detector switch 35 and relay contact 104, to conductors 101, 98–99, 96 and 94. Of course, the holding circuit will not be energized unless the sliver detector switch 35 detects the presence of a sliver moving properly into the coiler can 20, in the manner illustrated in FIG. 1.

In the meantime, normally open relay contacts 105 also form a part of a holding circuit with timer switch 114 when relay 100 causes the relay contacts 105 to close. The circuit is made from the transformer through conductors 92, 91, stop switch 106, conductors 110 and 112, relay contacts 105 and timer switch 114 to conductors 101, 98–99, 96 and 94. Timer switch 114 is a double pole switch and is in the position illustrated when the start button 90 is first closed.

When relay 100 is energized upon the closing of start switch 90, its contacts 105 also make a circuit from transformer 89 to conductor 115 to timer 116 through normally closed manual switch 118 and to conductors 96 and 94. This circuit causes timer 116 to be energized and to begin its timeout when the start switch 90 is first closed. When the timer times out, it opens its switch 114 so as to open the circuit to relay 100 and motor 38 which would stop motor 38 and open the relay contacts. In the meantime, however, if the sliver has been properly made up to the coiler can and properly engages the sliver detector switch 35, the holding circuit through detector switch 35 will be closed and the relay 100 and motor 38 will remain energized. When timer 116 times out and the sliver has been properly made up and detector switch 35 is closed, timer 116 moves its switch 114 from the position indicated to its alternate position, and a circuit is made from timer switch 114 through conductor 119 to solenoid valve 85 and to conductors 96 and 94. When solenoid valve 85 is energized, the source of pressurized air is then allowed to communicate with the fluid actuated ram 62 (FIG. 2), causing its ramrod 64 to distend, causing the variable pitch driving pulley 49 to progressively reduce its pitch. This causes the variable pitch pulley drive assembly 40 to smoothly and progressively increase the rotational speed of doffer cylinder 14 and feed cylinder 12 until these cylinders are operating at a constant high speed.

There may be occasions when the operator desires to have the carding machine function at low capacity for an extended time. The operator then merely opens manual switch 118 to take timer 116 out of the circuit, which causes timer switch 114 to remain in its illustrated closed position, which will keep motor 38 and relay 100 energized but which will prevent solenoid air valve 85 from being actuated and from shifting the drive system into its high speed condition, and the doffer cylinder and feed cylinder will continue to operate even if the sliver is not properly made up to the coiler.

Under normal conditions the manual switch 118 will remain closed at all times. When the carding machine operator starts the machine but does not properly make up the sliver to the coiler can within the predetermined time lapse so as to close the sliver detector switch 35 before the timer times out, both relay 100 and motor 38 will be de-energized. Moreover, if the sliver is properly made up to the coiler can within the prescribed period and the system should shift into its high speed condition and the sliver should subsequently break, the holding circuit through sliver detector switch 35 will open to de-energize motor 38 and relay 100 and to stop the rotation of the doffer cylinder, and the relay 100 will allow its contacts 102 to close again and illuminate lamp 109 and to open its contacts 104 and 105, thus causing the system to shift back to its low speed condition. With this arrangement, the system will always be in its slow speed condition when it is not operating, so that when the operator presses start switch 90, the system will always start in its slow speed condition and will shift into its high speed condition only if the sliver is made up to the coiler can within the period controlled by the timer 116.

When the system is deactivated, as by opening switch 87, or by opening stop switch 106 or by the absence of a sliver at detector switch 35, the doffer cylinder 14 and the other components of the system which are driven in unison with the doffer cylinder will stop independently of the main card cylinder 11. This causes the doffer to stop rapidly and to minimize the amount of waste produced by the machine, even though the main card cylinder may continue to be driven by its motor or may continue to rotate as it coasts to a stop.

The terms "feed cylinder" and "doffer cylinder" have been used to describe the specific feed cylinder and doffer cylinder arrangements shown in the drawing; however, it will be understood by those skilled in the art that these terms are to be construed to cover other types and arrangements of rotating feeding devices and doffing devices including licker-in rolls, feed rolls and takeoff rolls. Moreover, while this invention has been described in detail with particular reference to preferred embodiments thereof, it will be understood that variations and modifications can be effected within the spirit and scope of the invention as described hereinbefore and as defined in the appended claims.

We claim:

1. In a textile card system for working and forming cotton into a sliver including a rotatable main cylinder, a motor for rotating the main cylinder, a rotatable feed cylinder and a rotatable licker-in for feeding cotton to the main cylinder, a rotatable doffer cylinder for removing the cotton from the main cylinder, means for forming the cotton into a sliver, means for receiving the sliver, and a drive connection between said feed cylinder and said doffer cylinder to rotate said feed cylinder and doffer cylinder at a fixed speed ratio, the combination therewith of a variable speed drive system including a motor, a variable pitch drive pulley driven by said motor, a variable pitch driven pulley in driving connection with said doffer cylinder, a V-belt extending about said drive pulley and said driven pulley, means for varying the pitch of one of said pulleys and for varying the pitch of the other of said pulleys at a pitch inversely proportional to the pitch of said one of said pulleys, limiting means for variably limiting the pitch of said pulleys to variably limit the speed of said doffer cylinder and said feed cylinder and control means for sensing the sliver between the card system and the sliver receiving means for stopping the rotation of said doffer cylinder and said feed cylinder in response to the absence of a sliver being delivered from said card system to the sliver receiving means and for actuating said means for varying the pitch of one of said pulleys to increase the rotational speed of said doffer cylinder and said feed cylinder in response to the delivery of a sliver from said card system for a predetermined time at a slower speed.

2. The combination of claim 1 and wherein said means for varying the pitch of one of said pulleys and for varying the pitch of the other of said pulleys at a pitch inversely proportional to the pitch of one of said pulleys includes a fluid actuated ram member including means for engaging said drive pulley and reducing the pitch of said drive pulley, and wherein said limiting means for variably limiting the pitch of said pulleys comprises means for limiting the reduction of the pitch of said drive pulley.

3. In a textile card system for working cotton or the like and forming the cotton into a sliver including a card cylinder, a card motor for rotating the card cylinder, a doffing cylinder for removing the cotton from the card cylinder, means for forming the cotton into a sliver, and receiving means for receiving the sliver, the combination therewith of a variable speed drive system in driving relation with said doffing cylinder comprising a motor, a variable pitch driving pulley driven by said motor and including a first driving sheave half and a second driving sheave half movable toward and away from said first driving sheave half, a variable pitch driven pulley assembly in driving relationship with said doffing cylinder and including a first driven sheave half and a second driven sheave half movable toward and away from said first driven sheave half, spring means biasing said second sheave half of said driven sheave toward said first driven sheave half, a V-belt extending about said variable pitch driving pulley and said variable pitch driven pulley, fluid actuated ram means including means for engaging said second driving sheave half and urging said second driving sheave half toward said first driving sheave half to reduce the pitch of said variable pitch driving pulley and to increase the rotational speed of said variable pitch driven pulley and said doffing cylinder, detecting means for detecting the movement of the sliver from said means for forming the cotton into a sliver to said receiving means, said fluid actuated ram means being responsive to the detecting means detecting the presence of a sliver being formed by said card system to increase the rotational speed of said doffing cylinder.

4. The apparatus of claim 3 and further including means for variably limiting the movement of said ram means to limit the pitch of said driving pulley.

5. In a textile card system for continuously workinng cotton or the like and forming cotton into a sliver including a card cylinder, a cylinder drive motor for rotating the card cylinder, a rotatable doffing cylinder for removing the cotton from the card cylinder, and means for forming the cotton removed from the card cylinder into a sliver, the combination therewith of a doffer motor, a variable width driving sheave driven by said doffer motor, a variable width driven sheave in driving connection with said doffing cylinder, a belt member extending about said driven and driving sheaves whereby said doffing cylinder is rotated by said doffer motor, belt member, driving and driven sheaves and the speed of rotation of said doffing cylinder is varied by changing the widths of said driving and driven sheaves, and control means responsive to a time lapse and the absence of a sliver formed by the card system to terminate the rotation of said doffing cylinder or responsive to a time lapse and the presence of a sliver formed by the card system to change the widths of the driving and driven sheaves and increase the speed of rotation of said doffing cylinder.

* * * * *